United States Patent [19]

Strongwater

[11] Patent Number: 4,757,558

[45] Date of Patent: Jul. 19, 1988

[54] DECORATIVE GLOVE

[76] Inventor: Murray Strongwater, 326 Hewlett Neck Rd., Woodmere, N.Y. 11598

[21] Appl. No.: 47,624

[22] Filed: May 7, 1987

[51] Int. Cl.[4] ..... A41D 27/10

[52] U.S. Cl. ..... 2/170; 2/244; 2/269; 63/2

[58] Field of Search ..... 2/163, 170, 269, 244; 63/1 R, 2

[56] References Cited

U.S. PATENT DOCUMENTS

| | | | |
|---|---|---|---|
| D. 228,160 | 8/1973 | Harrison | D2/2 |
| 301,640 | 7/1884 | Swan et al. | 2/269 |
| 1,628,278 | 5/1927 | Scheuer | 63/2 |
| 1,691,445 | 11/1928 | Meliodon | 63/2 |
| 1,886,753 | 11/1932 | Steinberger | 2/170 |

*Primary Examiner*—Henry S. Jaudon
*Attorney, Agent, or Firm*—Henry R. Lerner

[57] ABSTRACT

A decorative glove for use with fashionwear, wherein the glove completes the fashion look at the wrist and arm areas of the wearer, by providing decorative ornamentation at the outer wrist area of the glove, which may be sleeveless, and terminate at the wrist area, or which may include sleeves which can also incorporate fashion features complementary to the wearer's dress. The decorative glove includes a thin elastic wrist strap; a decorative piece secured to the wrist strap and positioned thereon and a loop having two free ends secured to the wrist strap for removable securement about a finger of the wearer. Such glove leaves the wearer's hands substantially uncovered and unencumbered to perform all of its normal functions. In accordance with another embodiment of the invention, there is provided a sleeve extending rearwardly of the wrist strap, whereby such sleeve forms part of the fashion look of the glove to complement the wearer's dress.

7 Claims, 5 Drawing Sheets

DECORATIVE GLOVE

The present invention relates to a woman's decorative glove, and particularly to a fashion glove adapted to be used as a fashion look to complement and define an extension of the wearer's dress at the wrist and arm areas.

BACKGROUND AND BRIEF DESCRIPTION OF THE INVENTION

The completion of the fashion look at the wrist and arm areas of the wearer can be accomplished by providing decorative ornamentation at the outer wrist area of the glove which may be sleeveless and terminate at the wrist area or which may include sleeves which can also incorporate fashion features complementary to the wearer's dress. Such completion of the fashion look has been unsuccessful in prior art fashion gloves because such gloves included substantial coverage of the back of the hand, at least part of the palm of the hand and in most instances, part or all of the five fingers. Such coverage rendered the glove uncomfortable and cumbersome for the wearer, whose choice was to either remain uncomfortable or to remove the glove and, with it, the fashion statement provided thereby.

The hands of a woman constitute a major part of her fashion look and these hands are used constantly. It is, therefore, of utmost importance to keep a woman's hands unencumbered while allowing the fashionable woman to have her arms and hands as part of her fashion statement.

It is, therefore, a principal object of the invention to provide a fashion glove which completes and/or complements the fashion statement of the wearer's dress while leaving the wearer's hands substantially uncovered and completely unencumbered.

The decorative glove in accordance with one embodiment of the invention, comprises an elastic wrist band, a decorative element secured to the wrist band and a loop extending from the wrist band and adapted to be engaged by the wearer's middle finger for anchoring the wrist band in position wherein the decorative element is located at the outer area, and whereby the hand and fingers are substantially uncovered and totally unencumbered to permit complete unhampered use of the hands and fingers.

In accordance with other embodiments of the invention, the glove is further provided with a sleeve portion secured to the wrist band and extending rearwardly thereof, said sleeve portion forming part of the fashion statement extension of the wearer's dress.

Thus the glove, in accordance with the invention, is substantially invisible forwardly of the wrist band, allowing the hands to be used for any normal purpose such as eating, dancing or just sitting at a table. Further, the glove can be comfortably worn indoors without the discomfort and annoyance associated with prior art fashion gloves which cover a major part of the hands and fingers.

In the prior art gloves, which cover substantial portions of the palm and back of the hand, the material for making these portions must be stretchable, i.e., made of leather which has a natural inherent stretch or out of a knitted material, if a proper fit is to be obtained. Most dress material is not likely to be suitable for making gloves, being usually woven and not stretchable, thus making it impossible to complete the fashion look or theme. By contrast, this problem does not arise in the glove in accordance with invention which does not require any fabric forwardly of the wrist.

The glove, in accordance with the invention, embodies a novel construction heretofore unknown in the glove field, the mechanics of such construction allowing the entire palm area and back area and fingers to be completely uncovered, and unencumbered, thus providing for the unlimited use of decorative ornamentation at the wrist and/or rearwardly thereof, to complement the fashion look of the wearer's dress.

The above and other objects, features and advantages of the present invention will become readily apparent from the following detailed description which is to be read in connection with the accompanying drawings.

Figure 7:
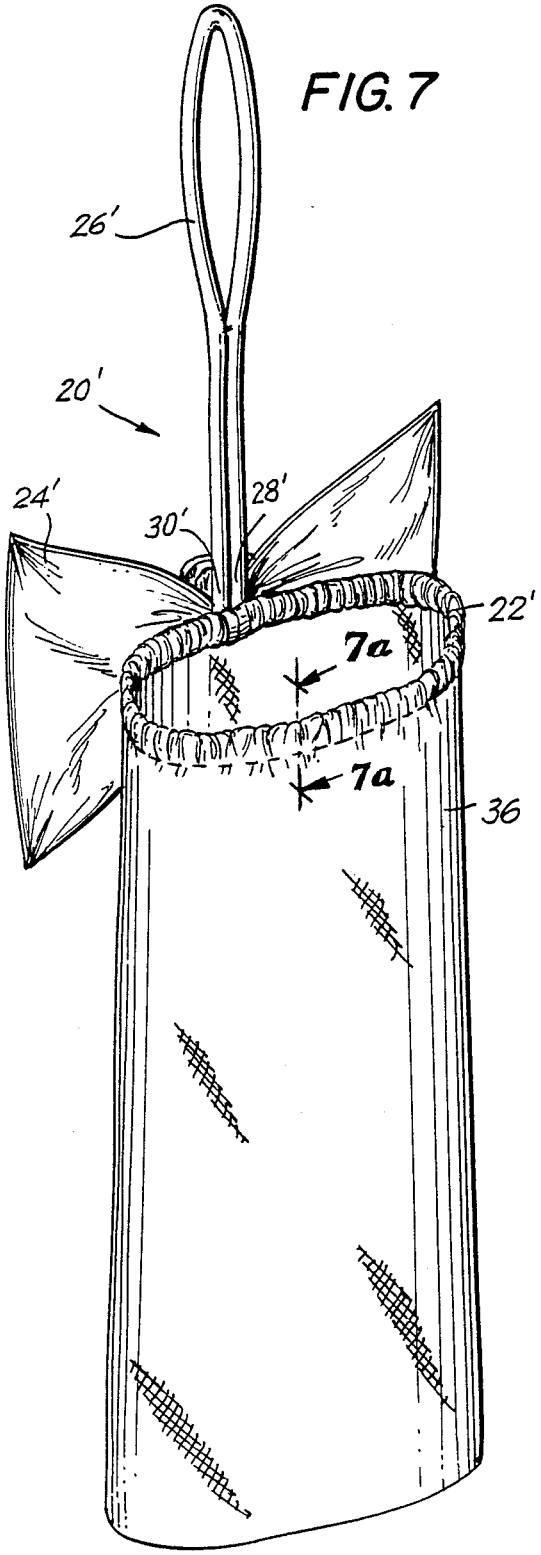
FIG. 7 is a perspective view of another embodiment in accordance with the invention; and FIG. *7a* is a sectional view taken along line a—a of FIG. 7.
Figure 8:
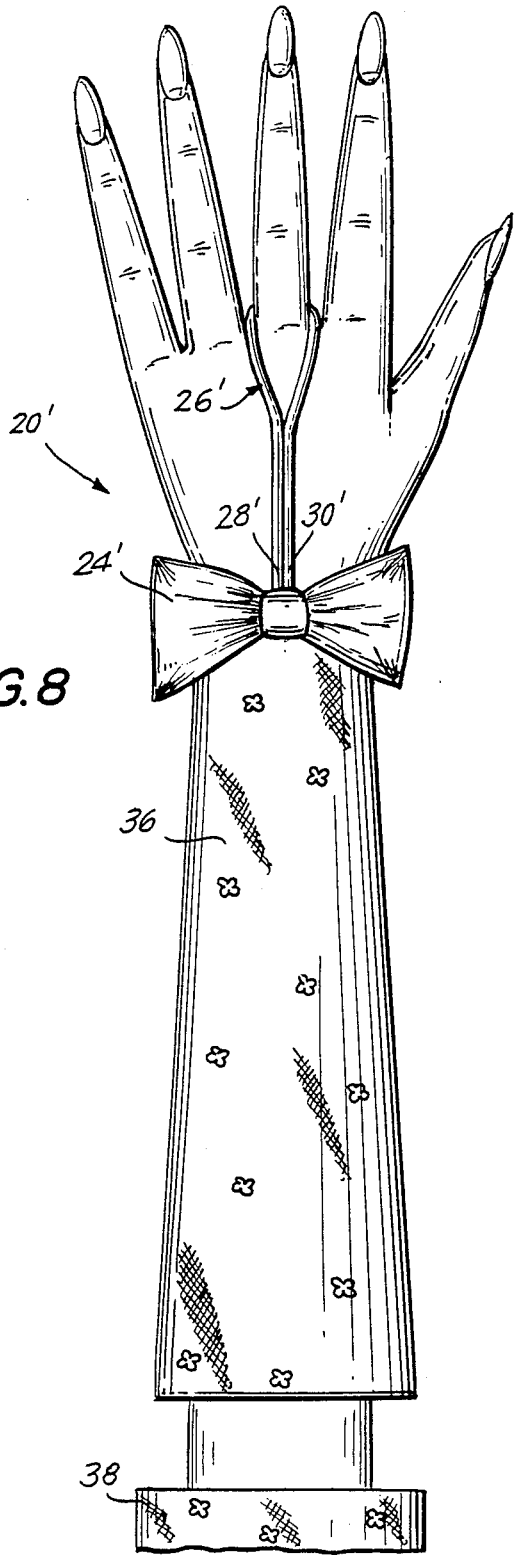

FIG. *7b* is a view similar to FIG. *7a*, but showing another embodiment;

FIG. 8 is a top plan view of the glove of FIG. 7, as worn by a woman.

DETAILED DESCRIPTION OF THE PREFERRED EMBODIMENTS

Figure 1:
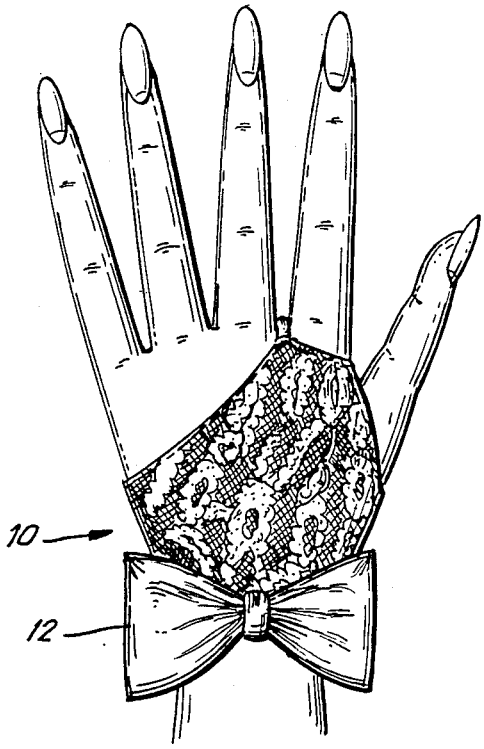
FIG. 1 PRIOR ART
FIG. 1 is a top plan view of a known decorative glove worn on a woman's hand.
Figure 2:
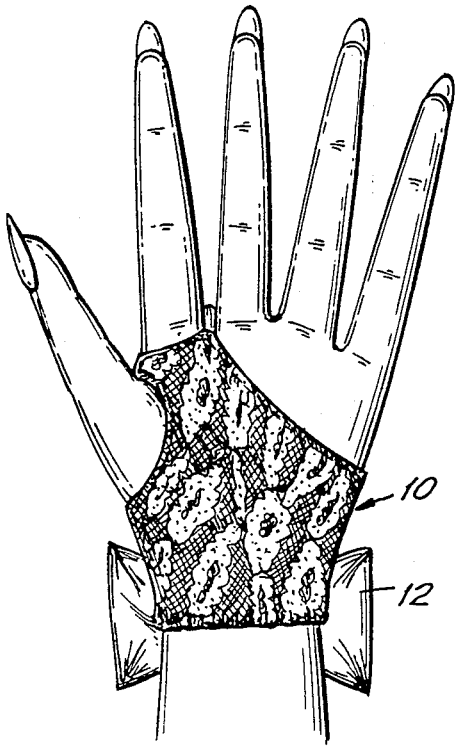
FIG. 2 PRIOR ART
FIG. 2 is a bottom plan view of the glove of FIG. 1.
Figure 3:
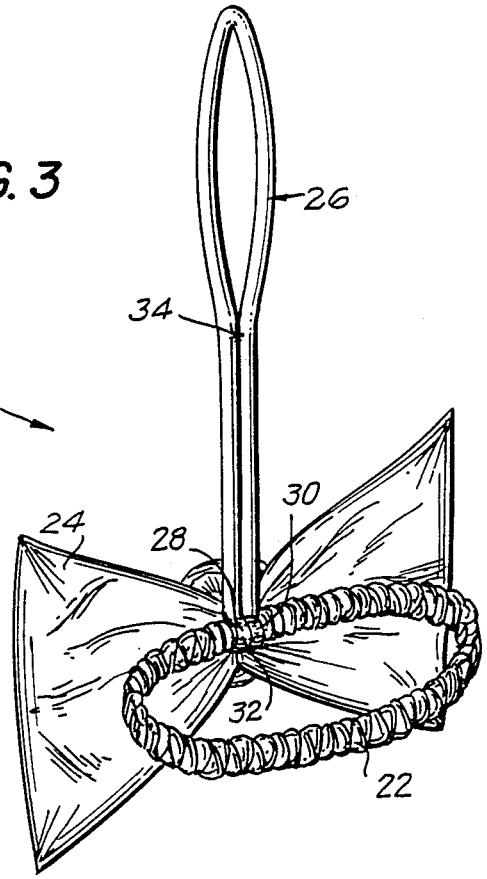
FIG. 3 is a front perspective view of a decorative glove according to one embodiment of the present invention.
Figure 4:
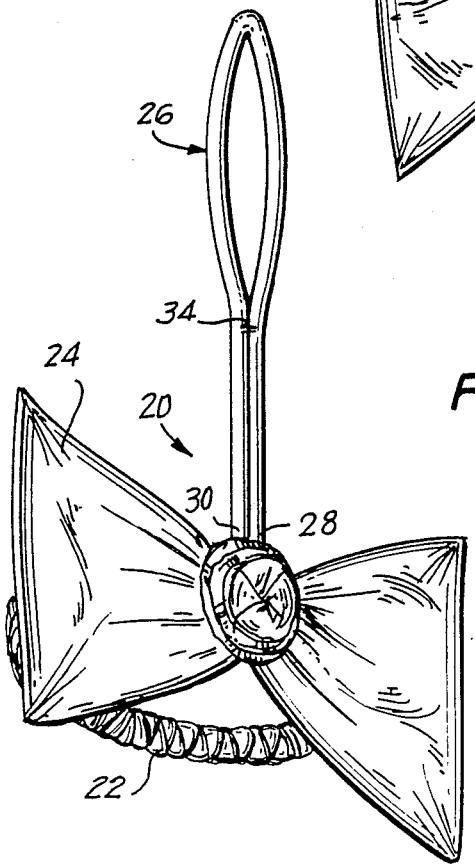
FIG. 4 is a rear perspective view of the glove of FIG. 3.

Referring to the drawings in detail, and initially to FIGS. 1 and 2 thereof, a known decorative glove 10 for use with formal wear, according to the prior art, is shown made from a lace material and having an intricate design thereon to match the material of a dress worn by a woman. A stretchable material, such as "Spandex" or the like, is woven into the fabric of the glove to provide that the glove will stretch over the hand of the woman. Glove 10 also includes a bow 12 at the wrist area to complete the fashion look.

However, as can readily be seen, glove 10 covers substantially the entire hand of the woman, leaving only the fingers and an extremely small area of the palm and back of the hand exposed. Such glove is often uncomfortable when worn indoors, particularly when eating, dancing, or even just sitting at a table. Further, it is necessary to add an additional stretchable material to the fabric, particularly in the palm area of the glove, to provide stretching thereof. However, even with the addition of these materials, it is extremely difficult, if not impossible, to make a useable, comfortable, decent fitting pair of gloves from a dress fabric, that is, which would allow a woman to have gloves that will match her dress. The combination of having the prior art fashion gloves cover the palm and back of the hand with the difficulty of providing the glove with a stretchable fabric which complements the dress fabric has substantially prevented such prior art gloves from satisfactorily being used to complete the fashion statement.

The present invention overcomes these problems by providing a decorative glove for use with formal wear that has a construction which leaves the fingers, palm and back of the hand uncovered, and thus unencumbered, while also providing a complementary fashion statement at the wrist and arm areas of the wearer. Further, the decorative glove according to the present invention permits the hands of a woman to be comfortable in any setting, unburdened by material covering the palm, the back or the fingers.

Referring now to FIGS. 3–6, a decorative glove 20 according to one embodiment of the present invention includes a narrow, annular wrist strap 22 made of elastic or stretchable material so as to snugly hug the wearer's wrist.

A decorative piece 24, such as a bow, flower and the like is secured to an outer surface of wrist strap 22 by any suitable means, and preferably by sewing.

Figure 5:
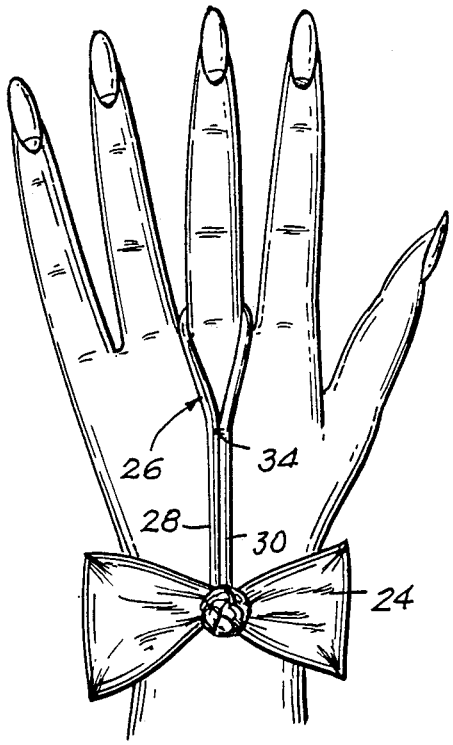
FIG. 5 is a top plan view of the glove of FIG. 3 being worn on a woman's hand.
Figure 6:
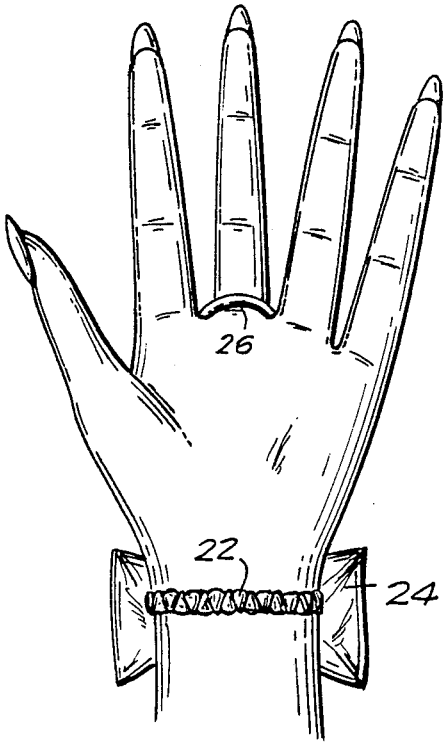
FIG. 6 is a bottom plan view of the glove of FIG. 5.

It is desirable to maintain wrist strap 22 in position, both rotatably and axially, on the wrist of the wearer to thereby center decorative piece 24 on the outer side thereof. In this regard, a loop 26 is provided. Loop 26 has two free ends 28 and 30 which are secured by stitching 32 to the inner surface of wrist strap 22. Loop 26 extends radially forward of wrist strap 22 so that a finger, preferably the middle finger, can be inserted through loop 26, as shown in FIGS. 5 and 6. Thus, loop 26 functions as an anchor for wrist strap 22. Free ends 28 and 30 may be stitched together, as at 34, midway therealong.

Thus, the embodiment of FIGS. 3–6 provides a decorative glove for use with formal wear that leaves the fingers, palm and back of the hand substantially uncovered and wholly unencumbered, while providing a fashion statement complementing the wearer's dress. The woman's hand is therefore free from all restrictions or coverage or enclosure and the glove is virtually invisible forwardly of the wrist strap, as best seen in FIGS. 5 and 6.

Figure 7A:
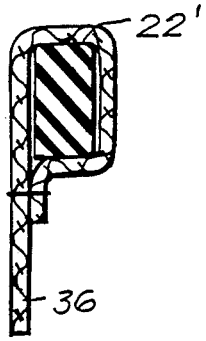
Figure 7B:
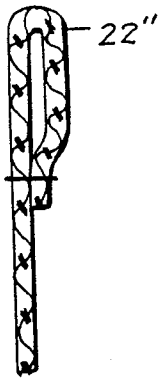

FIGS. 7 and 8 illustrate a fashion glove in accordance with another embodiment of the invention, in which elements identical to those of the first embodiment of FIGS. 3–6 are identified by the same numerals primed. Glove 20' is substantially identical in construction to aforedescribed glove 20 being provided with an annular wrist strap 22', a decorative piece 24' and loop 26', all of which function precisely in the same manner as their counterparts in FIG. 3. Glove 20' differs from glove 20 in that it is provided with a sleeve portion 36 extending rearwardly of the wrist strap 22'. Where the material of sleeve 36 is not stretchable its inner end is suitably secured to elastic strap 22', as shown in FIG. 7*a*. Where, however, the sleeve material is stretchable, its inner end, which may be doubled over, functions as wrist strap 22'' to which is attached decorative bow 24' and loop 26', as shown in FIG. 7*b*.

FIG. 8 illustrates glove 20' as worn to complement the fashion statement defined here by sleeve 38 of the wearer's dress. It is apparent that the material of glove sleeve 36 and decorative bow 24 can be selected to match that of dress sleeve 38. It is further apparent from FIG. 8 that glove 20' leaves the entire palm area, substantially all of the back area and the fingers, completely uncovered and unencumbered to allow the unlimited use of decorative ornamentation at the wrist and/or rearwardly thereof to complement the fashion look of the wearer's dress.

It is also apparent that sleeve 36 extending rearwardly of the wrist strap in FIG. 7 can be of medium length or of full length, and can be given various treatments to either length in order to complement the fashion statement in conjunction with the wearer's dress.

What is doable now, with the glove in accordance with the invention, and particularly due to the construction thereof, as described above, is the provision of unlimited fashion treatments for the glove sleeve including, for example, the use of a zipper side closing, the use of metal eyelets punched into the material, the use of rhinestones sewn on the different lengths, the use of sequins sewn on the different lengths, the use of a non-matching material specifically intended to contrast with the dress material. In effect, with the liberation of the hand to perform its normal functions, unburdened by glove material covering the hand, there is no treatment of the glove which is out of reach, whether the glove is of the type shown in FIGS. 3 to 6, in which case flexibility exists in providing different ornamental pieces, such as bows, flowers, etc.; or whether the embodiment of FIGS. 7 and 8 is used, providing a rearwardly extending sleeve which can be treated however a designer may wish to exercise his creative genius, without any physical restriction being imposed upon him.

Having described the preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. A decorative glove for use with fashion wear as a fashion extension thereof, comprising;

(a) a thin, elastic wrist strap;

(b) a decorative piece adapted to complement the fashion look of the wearer's dress secured to said wrist strap and positioned thereon;

(c) a loop having two free ends secured to said wrist strap, for removable engagement with a finger of the wearer for anchoring said decorative piece at a predetermined position on the wearer's wrist;

(d) whereby said decorative piece complements the fashion look of the wearer's dress while the hands and fingers of the wearer remain substantially uncovered and unencumbered for normal functions; and (e) a sleeve extending rearwardly from said wrist strap, said sleeve being ornamented so as to complement the fashion look of the wearer's dress.

2. A decorative glove in accordance with claim 1, wherein the predetermined position of said decorative piece is at the center of the outer side of the wrist when said loop is in engagement with the wearer's middle finger.

3. A decorative glove in accordance with claim 2, wherein the loop is shortened by stitching intermediate the wrist strap and the opposite end of the loop.

4. A decorative glove in accordance with claim 1, wherein said sleeve and said wrist strap constitute separate components which are connected together.

5. A decorative glove in accordance with claim 4, wherein said sleeve is made of non-stretchable fabric.

6. A decorative glove in accordance with claim 1, wherein said sleeve is made of stretchable material and defines at one end thereof said wrist strap.

7. A decorative glove in accordance with claim 1, wherein said sleeve is made of stretchable material and has a narrow doubled over end portion which defines said wrist strap.

* * * * *